US010323442B2

(12) United States Patent
Kleve et al.

(10) Patent No.: US 10,323,442 B2
(45) Date of Patent: Jun. 18, 2019

(54) ELECTRONIC SAFE DOOR UNLATCHING OPERATIONS

(71) Applicant: Ford Global Technologies, LLC, Dearborn, MI (US)

(72) Inventors: Robert Bruce Kleve, Ann Arbor, MI (US); John Thomas Ricks, Taylor, MI (US); Jim Michael Weinfurther, Farmington Hills, MI (US); John Robert Van Wiemeersch, Novi, MI (US); Ronald Patrick Brombach, Plymouth, MI (US); Laura Viviana Hazebrouck, Birmingham, MI (US); Lisa Therese Boran, Northville, MI (US); Howard Paul Tsvi Linden, Southfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 872 days.

(21) Appl. No.: 14/696,749

(22) Filed: Apr. 27, 2015

(65) Prior Publication Data

US 2015/0330115 A1 Nov. 19, 2015

Related U.S. Application Data

(63) Continuation-in-part of application No. 14/280,035, filed on May 16, 2014, now Pat. No. 10,119,308, (Continued)

(51) Int. Cl.
*E05B 77/48* (2014.01)
*E05B 81/76* (2014.01)
(Continued)

(52) U.S. Cl.
CPC ..... *E05B 77/48* (2013.01); *E05B 77/54* (2013.01); *E05B 81/14* (2013.01); *E05B 81/76* (2013.01); *Y10T 292/1047* (2015.04)

(58) Field of Classification Search
CPC ..... E05B 81/00; E05B 81/64
(Continued)

(56) References Cited

U.S. PATENT DOCUMENTS 2,229,909 A 1/1941 Wread
2,553,023 A 5/1951 Walters
(Continued)

FOREIGN PATENT DOCUMENTS

CN 1232936 C 12/2005
CN 201198681 Y 2/2009
(Continued)

OTHER PUBLICATIONS

Kistler Instruments, "Force Sensors Ensure Car Door Latch is Within Specification," Article, Jan. 1, 2005, 3 pages.
(Continued)

*Primary Examiner* — Carlos Lugo
(74) *Attorney, Agent, or Firm* — Vichit Chea; Price Heneveld LLP

(57) ABSTRACT

A powered latch system for motor vehicles includes at least one powered latch that can be controlled based, at least in part, on vehicle operating conditions. The system may be configured to control unlatching of the vehicle doors utilizing data relating to the vehicle speed and/or the existence of a crash event. The powered latch system can be configured as required for various vehicles, and to accommodate specific operating requirements with respect to child locks in various geographic jurisdictions.

13 Claims, 3 Drawing Sheets

Related U.S. Application Data which is a continuation-in-part of application No. 14/276,415, filed on May 13, 2014.

(51) Int. Cl.
*E05B 77/54* (2014.01)
*E05B 81/14* (2014.01)

(58) Field of Classification Search
USPC ..... 292/201, 216
See application file for complete search history.

(56) References Cited

U.S. PATENT DOCUMENTS 3,479,767 A 11/1969 Gardner et al.
3,605,459 A 9/1971 Van Dalen
3,751,718 A 8/1973 Hanchett
3,771,823 A 11/1973 Schnarr
3,854,310 A 12/1974 Paull
3,858,922 A 1/1975 Yamanaka
4,193,619 A 3/1980 Jeril
4,206,491 A 6/1980 Ligman et al.
4,425,597 A 1/1984 Schramm
4,457,148 A 7/1984 Johansson et al.
4,640,050 A 2/1987 Yamagishi et al.
4,672,348 A 6/1987 Duve
4,674,230 A 6/1987 Takeo et al.
4,674,781 A 6/1987 Reece et al.
4,702,117 A 10/1987 Tsutsumi et al.
4,848,031 A 6/1989 Yamagishi et al.
4,858,971 A * 8/1989 Haag ..... E05B 77/48 292/201
4,889,373 A 12/1989 Ward et al.
4,929,007 A 5/1990 Bartczak et al.
5,018,057 A 5/1991 Biggs et al.
5,056,343 A 10/1991 Kleefeldt et al.
5,058,258 A 10/1991 Harvey
5,074,073 A 12/1991 Zwebner
5,092,637 A 3/1992 Miller
5,239,779 A 8/1993 Deland et al.
5,263,762 A 11/1993 Long et al.
5,297,010 A 3/1994 Camarota et al.
5,332,273 A 7/1994 Komachi
5,334,969 A 8/1994 Abe et al.
5,494,322 A 2/1996 Menke
5,497,641 A 3/1996 Linde et al.
5,535,608 A 7/1996 Brin
5,547,208 A 8/1996 Chappell et al.
5,551,187 A 9/1996 Brouwer et al.
5,581,230 A 12/1996 Barrett
5,583,405 A 12/1996 Sai et al.
5,613,716 A 3/1997 Cafferty
5,618,068 A 4/1997 Mitsui et al.
5,632,120 A 5/1997 Shigematsu et al.
5,632,515 A 5/1997 Dowling
5,644,869 A 7/1997 Buchanan, Jr.
5,653,484 A 8/1997 Brackmann et al.
5,662,369 A 9/1997 Tsuge
5,684,470 A 11/1997 Deland et al.
5,744,874 A 4/1998 Yoshida et al.
5,755,059 A 5/1998 Schap
5,783,994 A 7/1998 Koopman, Jr. et al.
5,802,894 A 9/1998 Jahrsetz et al.
5,808,555 A 9/1998 Bartel
5,859,479 A 1/1999 David
5,895,089 A 4/1999 Singh et al.
5,896,026 A 4/1999 Higgins
5,896,768 A 4/1999 Cranick et al.
5,898,536 A 4/1999 Won
5,901,991 A 5/1999 Hugel et al.
5,921,612 A 7/1999 Mizuki et al.
5,927,794 A 7/1999 Mobius
5,964,487 A 10/1999 Shamblin
5,979,754 A 11/1999 Martin et al.
5,992,194 A 11/1999 Baukholt et al.
6,000,257 A 12/1999 Thomas
6,038,895 A 3/2000 Menke et al.
6,042,159 A 3/2000 Spitzley et al.
6,043,735 A 3/2000 Barrett
6,050,117 A 4/2000 Weyerstall
6,056,076 A 5/2000 Bartel et al.
6,065,316 A 5/2000 Sato et al.
6,072,403 A 6/2000 Iwasaki et al.
6,075,294 A 6/2000 Van den Boom et al.
6,091,162 A 7/2000 Williams, Jr. et al.
6,099,048 A 8/2000 Salmon et al.
6,125,583 A 10/2000 Murray et al.
6,130,614 A 10/2000 Miller
6,145,918 A 11/2000 Wilbanks, II
6,157,090 A 12/2000 Vogel
6,181,024 B1 1/2001 Geil
6,198,995 B1 3/2001 Settles et al.
6,241,294 B1 6/2001 Young et al.
6,247,343 B1 6/2001 Weiss et al.
6,256,932 B1 7/2001 Jyawook et al.
6,271,745 B1 8/2001 Anazi et al.
6,341,448 B1 1/2002 Murray
6,357,803 B1 3/2002 Lorek
6,361,091 B1 3/2002 Weschler
6,405,485 B1 6/2002 Itami et al.
6,406,073 B1 6/2002 Watanabe
6,441,512 B1 8/2002 Jakel et al.
6,460,905 B2 10/2002 Suss
6,470,719 B1 10/2002 Franz et al.
6,480,098 B2 11/2002 Flick
6,515,377 B1 2/2003 Uberlein et al.
6,523,376 B2 2/2003 Baukholt et al.
6,550,826 B2 4/2003 Fukushima et al.
6,554,328 B2 4/2003 Cetnar et al.
6,556,900 B1 4/2003 Brynielsson
6,602,077 B2 8/2003 Kasper et al.
6,606,492 B1 8/2003 Losey
6,629,711 B1 10/2003 Gleason et al.
6,639,161 B2 10/2003 Meagher et al.
6,640,174 B2 10/2003 Schondorf et al.
6,657,537 B1 12/2003 Hauler
6,659,515 B2 12/2003 Raymond et al.
6,701,671 B1 3/2004 Fukumoto et al.
6,712,409 B2 3/2004 Monig
6,715,806 B2 4/2004 Arlt et al.
6,734,578 B2 5/2004 Konno et al.
6,740,834 B2 5/2004 Sueyoshi et al.
6,768,413 B1 7/2004 Kemmann et al.
6,779,372 B2 8/2004 Arlt et al.
6,783,167 B2 8/2004 Bingle et al.
6,786,070 B1 9/2004 Dimig et al.
6,794,837 B1 9/2004 Whinnery et al.
6,825,752 B2 11/2004 Nahata et al.
6,829,357 B1 12/2004 Alrabady et al.
6,843,085 B2 1/2005 Dimig
6,854,870 B2 2/2005 Huizenga
6,879,058 B2 4/2005 Lorenz et al.
6,883,836 B2 4/2005 Breay et al.
6,883,839 B2 4/2005 Belmond et al.
6,910,302 B2 6/2005 Crawford
6,914,346 B2 7/2005 Girard
6,923,479 B2 * 8/2005 Aiyama ..... E05L 341/00 292/201
6,933,655 B2 8/2005 Morrison et al.
6,946,978 B2 9/2005 Schofield
7,005,959 B2 2/2006 Amagasa
7,038,414 B2 5/2006 Daniels et al.
7,055,997 B2 6/2006 Baek
7,062,945 B2 6/2006 Saitoh et al.
7,070,018 B2 7/2006 Kachouh
7,070,213 B2 7/2006 Willats et al.
7,090,285 B2 8/2006 Markevich et al.
7,091,823 B2 8/2006 Ieda et al.
7,091,836 B2 8/2006 Kachouh et al.
7,097,226 B2 8/2006 Bingle et al.
7,106,171 B1 9/2006 Burgess
7,108,301 B2 * 9/2006 Louvel ..... E05B 81/78 292/201
7,126,453 B2 10/2006 Sandau et al.

(56) References Cited

U.S. PATENT DOCUMENTS 7,145,436 B2 12/2006 Ichikawa et al.
7,158,870 B2 1/2007 Schondorf et al.
7,161,152 B2 1/2007 Dipoala
7,170,253 B2 1/2007 Spurr et al.
7,173,346 B2 2/2007 Aiyama et al.
7,176,810 B2 2/2007 Inoue
7,180,400 B2 2/2007 Amagasa
7,192,076 B2 3/2007 Ottino
7,204,530 B2 4/2007 Lee
7,205,777 B2 4/2007 Schultz et al.
7,221,255 B2 5/2007 Johnson et al.
7,222,459 B2 5/2007 Taniyama
7,248,955 B2 7/2007 Hein et al.
7,263,416 B2 8/2007 Sakurai et al.
7,270,029 B1 9/2007 Papanikolaou et al.
7,325,843 B2 2/2008 Coleman et al.
7,342,373 B2 3/2008 Newman et al.
7,360,803 B2 4/2008 Parent et al.
7,363,788 B2 4/2008 Dimig et al.
7,375,299 B1 5/2008 Pudney
7,399,010 B2 7/2008 Hunt et al.
7,446,645 B2 11/2008 Steegmann
7,576,631 B1 8/2009 Bingle et al.
7,642,669 B2 1/2010 Spurr
7,686,378 B2 3/2010 Gisler et al.
7,688,179 B2 3/2010 Kurpinski et al.
7,707,522 B2 4/2010 Shoemaker et al.
7,747,286 B2 6/2010 Conforti
7,780,207 B2 * 8/2010 Gotou ..... E05B 79/20 292/201
7,791,218 B2 * 9/2010 Mekky ..... E05L 377/02 307/10.1
7,926,385 B2 4/2011 Papanikolaou et al.
7,931,314 B2 4/2011 Nitawaki et al.
7,937,893 B2 5/2011 Pribisic
8,028,375 B2 10/2011 Nakaura et al.
8,093,987 B2 1/2012 Kurpinski et al.
8,126,450 B2 2/2012 Howarter et al.
8,141,296 B2 3/2012 Bem
8,141,916 B2 3/2012 Tomaszewski et al.
8,169,317 B2 5/2012 Lemerand et al.
8,193,462 B2 6/2012 Zanini et al.
8,224,313 B2 7/2012 Howarter et al.
8,272,165 B2 9/2012 Tomioke
8,376,416 B2 2/2013 Arabia, Jr. et al.
8,398,128 B2 3/2013 Arabia et al.
8,405,515 B2 3/2013 Ishihara et al.
8,405,527 B2 3/2013 Chung et al.
8,419,114 B2 4/2013 Fannon
8,451,087 B2 5/2013 Krishnan et al.
8,454,062 B2 6/2013 Rohlfing et al.
8,463,500 B2 6/2013 Cuddihy et al.
8,474,889 B2 7/2013 Reifenberg et al.
8,532,873 B1 9/2013 Bambenek
8,534,101 B2 9/2013 Mette et al.
8,544,901 B2 10/2013 Krishnan et al.
8,573,657 B2 11/2013 Papanikolaou et al.
8,584,402 B2 11/2013 Yamaguchi
8,616,595 B2 12/2013 Wellborn, Sr. et al.
8,648,689 B2 2/2014 Hathaway et al.
8,746,755 B2 6/2014 Papanikolaou et al.
8,826,596 B2 9/2014 Tensing
8,833,811 B2 9/2014 Ishikawa
8,903,605 B2 12/2014 Bambenek
8,915,524 B2 12/2014 Charnesky
8,963,701 B2 2/2015 Rodriguez
8,965,287 B2 2/2015 Lam
9,003,707 B2 4/2015 Reddmann
9,076,274 B2 7/2015 Kamiya
9,159,219 B2 10/2015 Magner et al.
9,184,777 B2 11/2015 Esselink et al.
9,187,012 B2 11/2015 Sachs et al.
9,189,900 B1 11/2015 Penilla et al.
9,260,882 B2 2/2016 Krishnan et al.
9,284,757 B2 3/2016 Kempel
9,322,204 B2 4/2016 Suzuki
9,353,566 B2 5/2016 Miu et al.
9,382,741 B2 7/2016 Konchan et al.
9,405,120 B2 8/2016 Graf
9,409,579 B2 8/2016 Eichin et al.
9,416,565 B2 8/2016 Papanikolaou et al.
9,475,369 B2 10/2016 Sugiura
9,481,325 B1 11/2016 Lange
9,493,975 B1 11/2016 Li
9,518,408 B1 12/2016 Krishnan
9,522,590 B2 12/2016 Fujimoto et al.
9,546,502 B2 1/2017 Lange
9,551,166 B2 1/2017 Patel et al.
9,725,069 B2 8/2017 Krishnan
9,777,528 B2 10/2017 Elie et al.
9,797,178 B2 10/2017 Elie et al.
9,834,964 B2 12/2017 Van Wiemeersch et al.
9,845,071 B1 12/2017 Krishnan
9,903,142 B2 2/2018 Van Wiemeersch et al.
9,909,344 B2 3/2018 Krishnan et al.
9,957,737 B2 5/2018 Patel et al.
2001/0005078 A1 6/2001 Fukushima et al.
2001/0030871 A1 10/2001 Anderson
2002/0000726 A1 1/2002 Zintler
2002/0111844 A1 8/2002 Vanstory et al.
2002/0121967 A1 9/2002 Bowen et al.
2002/0186144 A1 12/2002 Meunier
2003/0009855 A1 * 1/2003 Budzynski ..... E05B 81/78 16/443
2003/0025337 A1 2/2003 Suzuki et al.
2003/0038544 A1 2/2003 Spurr
2003/0101781 A1 6/2003 Budzynski et al.
2003/0107473 A1 6/2003 Pang et al.
2003/0111863 A1 6/2003 Weyerstall et al.
2003/0139155 A1 7/2003 Sakai
2003/0172695 A1 9/2003 Buschmann
2003/0182863 A1 10/2003 Mejean et al.
2003/0184098 A1 10/2003 Aiyama
2004/0061462 A1 4/2004 Bent et al.
2004/0093155 A1 5/2004 Simonds et al.
2004/0124708 A1 7/2004 Giehler et al.
2004/0195845 A1 10/2004 Chevalier
2004/0217601 A1 11/2004 Garnault et al.
2005/0057047 A1 * 3/2005 Kachouh ..... E05L 381/14 292/201
2005/0068712 A1 3/2005 Schulz et al.
2005/0216133 A1 9/2005 MacDougall et al.
2005/0218913 A1 10/2005 Inaba
2006/0056663 A1 3/2006 Call
2006/0100002 A1 5/2006 Luebke et al.
2006/0186987 A1 8/2006 Wilkins
2007/0001467 A1 1/2007 Muller et al.
2007/0090654 A1 4/2007 Eaton
2007/0115191 A1 5/2007 Hashiguchi et al.
2007/0120645 A1 5/2007 Nakashima
2007/0126243 A1 6/2007 Papanikolaou et al.
2007/0132553 A1 6/2007 Nakashima
2007/0170727 A1 7/2007 Kohlstrand et al.
2008/0021619 A1 1/2008 Steegmann et al.
2008/0060393 A1 3/2008 Johansson et al.
2008/0068129 A1 3/2008 Ieda et al.
2008/0129446 A1 6/2008 Vader
2008/0143139 A1 6/2008 Bauer et al.
2008/0202912 A1 8/2008 Boddie et al.
2008/0203737 A1 8/2008 Tomaszewski et al.
2008/0211623 A1 9/2008 Scheurich
2008/0217956 A1 9/2008 Gschweng et al.
2008/0224482 A1 9/2008 Cumbo et al.
2008/0230006 A1 9/2008 Kirchoff et al.
2008/0250718 A1 10/2008 Papanikolaou et al.
2008/0296927 A1 12/2008 Gisler et al.
2008/0303291 A1 12/2008 Spurr
2008/0307711 A1 12/2008 Kern et al.
2009/0033104 A1 2/2009 Konchan et al.
2009/0033477 A1 2/2009 Illium et al.
2009/0145181 A1 6/2009 Pecoul et al.
2009/0160211 A1 6/2009 Krishnan et al.
2009/0177336 A1 7/2009 McClellan et al.
2009/0240400 A1 9/2009 Lachapelle et al.

(56) References Cited

U.S. PATENT DOCUMENTS

| | | | |
|---|---|---|---|
| 2009/0257241 | A1 | 10/2009 | Meinke et al. |
| 2010/0007463 | A1 | 1/2010 | Dingman et al. |
| 2010/0052337 | A1 | 3/2010 | Arabia et al. |
| 2010/0060505 | A1 | 3/2010 | Witkowski |
| 2010/0097186 | A1 | 4/2010 | Wielebski |
| 2010/0175945 | A1 | 7/2010 | Helms |
| 2010/0235057 | A1 | 9/2010 | Papanikolaou et al. |
| 2010/0235058 | A1 | 9/2010 | Papanikolaou et al. |
| 2010/0235059 | A1 | 9/2010 | Krishnan et al. |
| 2010/0237635 | A1 | 9/2010 | Ieda et al. |
| 2010/0253535 | A1 | 10/2010 | Thomas |
| 2010/0265034 | A1 | 10/2010 | Cap et al. |
| 2010/0315267 | A1* | 12/2010 | Chung ..... B60R 25/24 341/22 |
| 2011/0041409 | A1 | 2/2011 | Newman et al. |
| 2011/0060480 | A1 | 3/2011 | Mottla et al. |
| 2011/0148575 | A1 | 6/2011 | Sobecki et al. |
| 2011/0154740 | A1 | 6/2011 | Matsumoto et al. |
| 2011/0180350 | A1 | 7/2011 | Thacker |
| 2011/0203181 | A1 | 8/2011 | Magner et al. |
| 2011/0203336 | A1 | 8/2011 | Mette et al. |
| 2011/0227351 | A1 | 9/2011 | Grosdemouge |
| 2011/0248862 | A1 | 10/2011 | Budampati |
| 2011/0252845 | A1 | 10/2011 | Webb et al. |
| 2011/0254292 | A1 | 10/2011 | Ishii |
| 2011/0313937 | A1 | 12/2011 | Moore, Jr. et al. |
| 2012/0119524 | A1 | 5/2012 | Bingle et al. |
| 2012/0154292 | A1 | 6/2012 | Zhao et al. |
| 2012/0180394 | A1 | 7/2012 | Shinohara |
| 2012/0205925 | A1 | 8/2012 | Muller et al. |
| 2012/0228886 | A1 | 9/2012 | Muller et al. |
| 2012/0252402 | A1 | 10/2012 | Jung |
| 2013/0049403 | A1 | 2/2013 | Fannon et al. |
| 2013/0069761 | A1 | 3/2013 | Tieman |
| 2013/0079984 | A1 | 3/2013 | Aerts et al. |
| 2013/0104459 | A1 | 5/2013 | Patel et al. |
| 2013/0127180 | A1 | 5/2013 | Heberer et al. |
| 2013/0138303 | A1 | 5/2013 | McKee et al. |
| 2013/0207794 | A1 | 8/2013 | Patel |
| 2013/0282226 | A1 | 10/2013 | Pollmann |
| 2013/0295913 | A1 | 11/2013 | Matthews, III et al. |
| 2013/0311046 | A1 | 11/2013 | Heberer et al. |
| 2013/0321065 | A1 | 12/2013 | Salter et al. |
| 2013/0325521 | A1 | 12/2013 | Jameel |
| 2014/0000165 | A1 | 1/2014 | Patel et al. |
| 2014/0007404 | A1 | 1/2014 | Krishnan et al. |
| 2014/0015637 | A1 | 1/2014 | Dassanakake et al. |
| 2014/0088825 | A1 | 3/2014 | Lange et al. |
| 2014/0129113 | A1 | 5/2014 | Van Wiemeersch et al. |
| 2014/0150581 | A1 | 6/2014 | Scheuring et al. |
| 2014/0156111 | A1 | 6/2014 | Ehrman |
| 2014/0188999 | A1 | 7/2014 | Leonard et al. |
| 2014/0200774 | A1 | 7/2014 | Lange et al. |
| 2014/0227980 | A1 | 8/2014 | Esselink et al. |
| 2014/0242971 | A1 | 8/2014 | Aladenize et al. |
| 2014/0245666 | A1 | 9/2014 | Ishida et al. |
| 2014/0256304 | A1 | 9/2014 | Frye et al. |
| 2014/0278599 | A1 | 9/2014 | Reh |
| 2014/0293753 | A1 | 10/2014 | Pearson |
| 2014/0338409 | A1 | 11/2014 | Kraus et al. |
| 2014/0347163 | A1 | 11/2014 | Banter et al. |
| 2015/0001926 | A1 | 1/2015 | Kageyama et al. |
| 2015/0048927 | A1 | 2/2015 | Simmons |
| 2015/0059250 | A1 | 3/2015 | Miu et al. |
| 2015/0084739 | A1 | 3/2015 | Lemoult et al. |
| 2015/0149042 | A1 | 5/2015 | Cooper et al. |
| 2015/0161832 | A1 | 6/2015 | Esselink et al. |
| 2015/0197205 | A1 | 7/2015 | Xiong |
| 2015/0240548 | A1 | 8/2015 | Bendel et al. |
| 2015/0294518 | A1 | 10/2015 | Peplin |
| 2015/0330112 | A1 | 11/2015 | Van Wiemeersch et al. |
| 2015/0330113 | A1 | 11/2015 | Van Wiemeersch et al. |
| 2015/0330114 | A1 | 11/2015 | Linden et al. |
| 2015/0330117 | A1 | 11/2015 | Van Wiemeersch et al. |
| 2015/0360545 | A1 | 12/2015 | Nanla |
| 2015/0371031 | A1 | 12/2015 | Ueno et al. |
| 2016/0060909 | A1 | 3/2016 | Krishnan et al. |
| 2016/0130843 | A1 | 5/2016 | Bingle |
| 2016/0138306 | A1 | 5/2016 | Krishnan et al. |
| 2016/0153216 | A1 | 6/2016 | Funahashi et al. |
| 2016/0326779 | A1 | 11/2016 | Papanikolaou et al. |
| 2017/0014039 | A1 | 1/2017 | Pahlevan et al. |
| 2017/0074006 | A1 | 3/2017 | Patel et al. |
| 2017/0247016 | A1 | 8/2017 | Krishnan |
| 2017/0270490 | A1 | 9/2017 | Penilla et al. |
| 2017/0306662 | A1 | 10/2017 | Och et al. |
| 2017/0349146 | A1 | 12/2017 | Krishnan |
| 2018/0038147 | A1 | 2/2018 | Linden et al. |
| 2018/0051493 | A1 | 2/2018 | Krishnan et al. |
| 2018/0051498 | A1 | 2/2018 | Van Wiemeersch et al. |
| 2018/0058128 | A1 | 3/2018 | Khan et al. |
| 2018/0065598 | A1 | 3/2018 | Krishnan |
| 2018/0080270 | A1 | 3/2018 | Khan et al. |
| 2018/0128022 | A1 | 5/2018 | Van Wiemeersh et al. |

FOREIGN PATENT DOCUMENTS

| | | | |
|---|---|---|---|
| CN | 201280857 | | 7/2009 |
| CN | 101527061 | A | 9/2009 |
| CN | 201567872 | U | 9/2010 |
| CN | 101932466 | A | 12/2010 |
| CN | 201915717 | U | 8/2011 |
| CN | 202200933 | U | 4/2012 |
| CN | 202686247 | U | 1/2013 |
| CN | 103206117 | A | 7/2013 |
| CN | 103264667 | A | 8/2013 |
| CN | 203511548 | U | 4/2014 |
| CN | 204326814 | U | 5/2015 |
| DE | 4403655 | A1 | 8/1995 |
| DE | 19620059 | A1 | 11/1997 |
| DE | 19642698 | A2 | 11/2000 |
| DE | 19642698 | C2 | 11/2000 |
| DE | 10212794 | A1 | 6/2003 |
| DE | 20121915 | U1 | 11/2003 |
| DE | 10309821 | A1 | 9/2004 |
| DE | 102005041551 | A1 | 3/2007 |
| DE | 102006029774 | A1 | 1/2008 |
| DE | 102006041928 | A1 | 3/2008 |
| DE | 102010052582 | A1 | 5/2012 |
| DE | 102011051165 | A1 | 12/2012 |
| DE | 102015101164 | A1 | 7/2015 |
| DE | 102014107809 | A1 | 12/2015 |
| EP | 0372791 | A2 | 6/1990 |
| EP | 0694664 | A1 | 1/1996 |
| EP | 1162332 | A1 | 12/2001 |
| EP | 1284334 | A1 | 2/2003 |
| EP | 1288403 | A2 | 3/2003 |
| EP | 1284334 | A1 | 9/2003 |
| EP | 1460204 | A2 | 9/2004 |
| EP | 1465119 | A1 | 10/2004 |
| EP | 1338731 | A3 | 2/2005 |
| EP | 1944436 | A2 | 7/2008 |
| EP | 2053744 | A2 | 4/2009 |
| EP | 2314803 | A2 | 4/2011 |
| FR | 2698838 | A1 | 6/1994 |
| FR | 2783547 | A1 | 3/2000 |
| FR | 2841285 | A1 | 12/2003 |
| FR | 2948402 | A1 | 7/2009 |
| FR | 2955604 | A1 | 7/2011 |
| GB | 2402840 | A | 12/2004 |
| GB | 2496754 | A | 5/2013 |
| JP | 62255256 | A | 11/1987 |
| JP | 05059855 | A | 3/1993 |
| JP | 06167156 | A | 6/1994 |
| JP | 406185250 | A | 7/1994 |
| JP | 2000064685 | A | 2/2000 |
| JP | 2000314258 | A | 11/2000 |
| JP | 2007138500 | A | 6/2007 |
| KR | 20030025738 | A | 3/2003 |
| KR | 20120108580 | A | 10/2012 |
| WO | 0123695 | A1 | 4/2001 |
| WO | 03095776 | A1 | 11/2003 |

(56) References Cited

FOREIGN PATENT DOCUMENTS

| | | | |
|---|---|---|---|
| WO | 2013111615 | A1 | 8/2013 |
| WO | 2013146918 | A1 | 10/2013 |
| WO | 2014146186 | A1 | 9/2014 |

OTHER PUBLICATIONS

Department of Transportation, "Federal Motor Vehicle Safety Standards; Door Locks and Door Retention Components and Side Impact Protection," http://www.nhtsa.gov/cars/rules/rulings/DoorLocks/DoorLocks_NPRM.html#VI_C, 23 pages, Aug. 28, 2010.
U.S. Appl. No. 14/276,415, filed May 13, 2014, entitled "Customer Coaching Method for Location of E-Latch Backup Handles." 25 pages.
U.S. Appl. No. 14/281,998, filed May 20, 2014, entitled "Vehicle Door Handle and Powered Latch System." 28 pages.
U.S. Appl. No. 14/282,224, filed May 20, 2014, entitled Powered Vehicle Door Latch and Exterior Handle With Sensor. 22 pages.
U.S. Appl. No. 14/280,035, filed May 16, 2014, entitled "Powered Latch System for Vehicle Doors and Control System Therefor." 28 pages.
Module Communications Network, 2007 Mustang, Mustang GT Aug. 2006, Copyright 2006, Ford Motor Company, last updated: Jun. 19, 2006, pp. 418-00-1-418-00-2 (2 pages).
Module Communications Network, 2011 Mustang, Feb. 2011, 418-00-i-418-00-3 (3 pages).
Mahmud et al., "In-Vehicle Network Architecture for the Next-Generation Vehicles", SAE Technical Paper Series 2005-01-1531, 2005 SAE World Congress, Detroit, Michigan, Apr. 11-14, 2006 (12 pages).
Zipcar.com, "Car Sharing from Zipcar: How Does car Sharing Work?" Feb. 9, 2016, 6 pages.
PRWEB, "Keyfree Technologies Inc. Launches the First Digital Car Key," Jan. 9, 2014, 3 pages.
"Push Button to open your car door" Online video clip. YouTube, Mar. 10, 2010. 1 page.
Car of the Week: 1947 Lincoln convertible By: bearnest May 29, 2012 http://www.oldcarsweekly.com/car-of-the-week/car-of-the-week-1947-lincoln-convertible. 7 pages.
U.S. Appl. No. 14/276,415, Office Action dated Mar. 28, 2018, 19 pages.
U.S. Appl. No. 12/402,744, Office Action dated Oct. 23, 2013, 7 pages.
U.S. Appl. No. 12/402,744, Advisory Action dated Jan. 31, 2014, 2 pages.
Keyfree Technologies Inc., "Keyfree," website, Jan. 10, 2014, 2 pages.
Hyundai Motor India Limited, "Hyundai Care," website, Dec. 8, 2015, 3 pages.
George Kennedy, "Keyfree app replaces conventional keys with your smart phone," website, Jan. 5, 2015, 2 pages.
Office Action dated Mar. 10, 2017, U.S. Appl. No. 15/174,206, filed Jun. 6, 2016, 17 pages.
General Motors Corporation, 2006 Chevrolet Corvette Owner Manual, © 2005 General Motors Corporation, 4 pages.
General Motors LLC, 2013 Chevrolet Corvette Owner Manual, 2012, 17 pages.
General Motors, "Getting to Know Your 2014 Corvette," Quick Reference Guide, 2013, 16 pages.
InterRegs Ltd., Federal Motor Vehicle Safety Standard, "Door Locks and Door Retention Components," 2012, F.R. vol. 36 No. 232—Feb. 12, 1971, 23 pages.
Ross Downing, "How to Enter & Exit a Corvette With a Dead Battery," YouTube video http://www.youtube.com/watch?v=DLDqmGQU6L0, Jun. 6, 2011, 1 page.
Jeff Glucker, "Friends videotape man 'trapped' inside C6 Corette with dead battery," YouTube via Corvett Online video http://www.autoblog.com/2011/05/14/friends-videotape-man-trapped-inside-c6-corvette-with-dead-bat/, May 14, 2011, 1 page.
Don Roy, "ZR1 Owner Calls 911 After Locking Self in Car," website http://www.corvetteonline.com/news/zr1-owner-calls-911-after-locking-self-in-car/, Apr. 13, 2011, 2 pages.
Zach Bowman, "Corvette with dead battery traps would-be thief," website http://www.autoblog.com/2011/10/25/corvette-with-dead-battery-traps-would-be-thief/, Oct. 25, 2011, 2 pages.
U.S. Appl. No. 14/468,634, filed Aug. 26, 2014, 15 pages.
U.S. Appl. No. 13/608,303, filed Sep. 10, 2012, 15 pages.
Bryan Laviolette, "GM's New App Turns Smartphones into Virtual Keys," Article, Jul. 22, 2010, 2 pages.
Hyundai Bluelink, "Send Directions to your car," Link to App, 2015, 3 pages.
State Intellectual Property Office of the People's Republic of China, Notification of First Office Action, Application No. 201610249046.6, dated Dec. 13, 2018 (8 pages).

* cited by examiner

ELECTRONIC SAFE DOOR UNLATCHING OPERATIONS

CROSS-REFERENCE TO RELATED APPLICATIONS

This patent application is a continuation-in-part of U.S. patent application Ser. No. 14/280,035, which was filed on May 16, 2014, entitled "POWERED LATCH SYSTEM FOR VEHICLE DOORS AND CONTROL SYSTEM THEREFOR," now U.S. Pat. No. 10,119,308, issued on Nov. 6, 2018, which is a continuation-in-part of U.S. patent application Ser. No. 14/276,415, which was filed on May 13, 2014, entitled "CUSTOMER COACHING METHOD FOR LOCATION OF E-LATCH BACKUP HANDLES." The entire disclosures of each are incorporated herein by reference.

FIELD OF THE INVENTION

The present invention generally relates to latches for doors of motor vehicles, and more particularly, to a powered latch system and controller that only unlatches the powered latch if predefined operating conditions/parameters are present.

BACKGROUND OF THE INVENTION

Electrically powered latches ("E-latches") have been developed for motor vehicles. Known powered door latches may be unlatched by actuating an electrical switch. Actuation of the switch causes an electric motor to shift a pawl to a released/unlatched position that allows a claw of the latch to move and disengage from a striker to permit opening of the vehicle door. E-latches may include a mechanical emergency/backup release lever that can be manually actuated from inside the vehicle to unlatch the powered latch if the powered latch fails due to a loss of electrical power or other malfunction.

SUMMARY OF THE INVENTION

One aspect of the present invention is a latch system for vehicle doors. The latch system includes a powered latch including a powered actuator that is configured to unlatch the powered latch. An interior unlatch input feature such as an unlatch switch can be actuated by a user to provide an unlatch request.

The system may include a controller that is operably connected to the powered latch. The controller may be configured (i.e. programmed) such that it does not unlatch the powered latch if a vehicle speed is greater than a predefined value unless the interior unlatch feature is actuated at least two times within a predefined period of time.

In addition to the unlatch switch, the latch system may include an unlock input feature such as an unlock switch mounted on an inner side of a vehicle door that can be actuated by a user to provide an unlock request. The controller may be in communication with both the interior unlatch switch and the unlock switch. The controller may be configured to cause the powered latch to unlatch if a total of at least three discreet inputs in any combination are received from the interior unlatch input feature and/or the unlock input feature within a predefined time interval. The at least three discreet inputs are selected from a group including an unlatch request and an unlock request.

The system may include a control module that is configured to detect a crash event and cause airbags and/or other passenger constraints to be deployed. The controller may be configured to communicate with the control module by only a selected one of a digital data communication network and one or more electrical conductors extending between the controller and the control module. The controller is configured to operate in a first mode wherein a single actuation of the interior unlatch input feature may be sufficient to unlatch the powered latch, and a second mode in which the controller requires at least two discreet actuations of the interior unlatch input feature within a predefined time interval to unlatch the powered latch. The controller is configured to utilize the second mode if communication with the control module is interrupted or lost.

The controller may be configured to communicate with the control module utilizing a digital data communication network and one or more electrical conductors extending between the controller and the control module. The controller may be configured to operate in a first mode wherein a single actuation of the interior unlatch input feature may be sufficient to unlatch the powered latch, and a second mode in which the controller requires at least two discreet actuations of the interior unlatch input feature within a predefined time interval to unlatch the powered latch. The controller utilizes the first operating mode if the controller is able to communicate with the control module utilizing at least one of the data communications network and the electrical conductors. The controller utilizes the second operating mode if the controller is unable to communicate properly according to predefined criteria with the control module utilizing either the data communications network or the electrical conductors.

The powered latch may be configured to be connected to a main vehicle electrical power supply, and the powered latch may include a secondary electrical power supply capable of providing sufficient electrical power to actuate the powered actuator if the main vehicle electrical power supply is interrupted. The controller may be operably connected to the powered actuator. The controller is configured to operate in first and second modes. In the first mode, a single actuation of the interior unlatch input feature is sufficient to unlatch the powered latch. In the second mode, the controller requires at least two discreet actuations of the interior unlatch input feature within a predefined time interval to unlatch the powered latch. The controller is configured to utilize the second operating mode if the main vehicle electrical power supply is interrupted.

The controller may be configured to communicate with a control module utilizing a digital data communication network and one or more electrical conductors extending between the controller and the control module. The controller may be configured to operate in first and second modes. In the first mode, a single actuation of the interior unlatch input feature may be sufficient to unlatch the powered latch. In the second mode, the controller is configured to require at least two discreet actuations of the interior unlatch input feature within a predefined time interval to unlatch the powered latch. The controller is configured to utilize the second operating mode if communication with the control module utilizing the digital data communication network is interrupted, even if the controller maintains communication with the control module utilizing the one or more electrical conductors.

Another aspect of the present invention is a latch system for vehicle doors including a powered latch having a powered actuator that is configured to unlatch the powered latch.

The latch system also includes an interior unlatch input feature that can be actuated by a user to provide an unlatch request. The latch system further includes an interior unlock input feature that can be actuated by a user to provide an unlock request. A controller is operably connected to the powered latch, and the controller is configured such that it does not unlatch the powered latch if a vehicle speed is greater than a predefined value unless the interior unlock feature is actuated followed by actuation of the interior unlatch feature within a predefined time interval following actuation of the interior unlock feature.

Another aspect of the present invention is a latch system for vehicle doors including a powered latch having a powered actuator that is configured to unlatch the powered latch. The latch system further includes an interior unlatch input feature that can be actuated by a user to provide an unlatch request. The latch system further includes a controller in communication with the interior unlatch input feature. The controller causes the powered latch to unlatch if predefined unlatch criteria exists. The predefined unlatch criteria includes actuation of the interior unlatch input feature at a first time and at least one additional user input that occurs within a predefined first time interval from the first time, unless the controller determines that a vehicle crash has occurred at a second time, in which case the controller does not cause the powered latch to unlatch even if the predefined unlatch criteria exists during a predefined second time interval from the second time, such that the controller does not cause the powered latch to unlatch until after the second time interval.

Another aspect of the present invention is a method of reconfiguring a latch system for vehicle rear doors. The method includes providing a powered rear door latch including a powered actuator that is configured to unlatch the powered latch. The method also includes providing a rear door interior unlatch input feature that can be actuated by a user to provide a rear door unlatch request. The method further includes providing a child lock input feature that can be actuated by a user to set a child lock feature to on and off states. The method further includes operably connecting a controller to the powered actuator. The controller may be configured to provide first and/or second operating logic as required to comply with first and second criteria corresponding to first and second geographic regions, respectively. The method further includes configuring the controller such that actuation of the rear door interior unlatch input feature does not actuate the powered actuator to unlatch the powered latch if the child lock feature is in an on state when the controller is configured to provide the first operating logic and when the controller is configured to provide the second operating logic. The first operating logic requires actuation of the rear door interior unlatch input feature and at least one separate input action that is distinct from actuation of the rear door interior unlatch input feature to actuate the powered actuator and unlatch the powered latch when the child lock feature is in an off state. The second operating logic actuates the powered actuator and unlatches the powered latch if the rear door interior unlatch input feature is actuated once even if a separate input action is not taken when the child lock feature is in an off state. The method further includes configuring the controller to operate according to either the first control logic or the second control logic.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
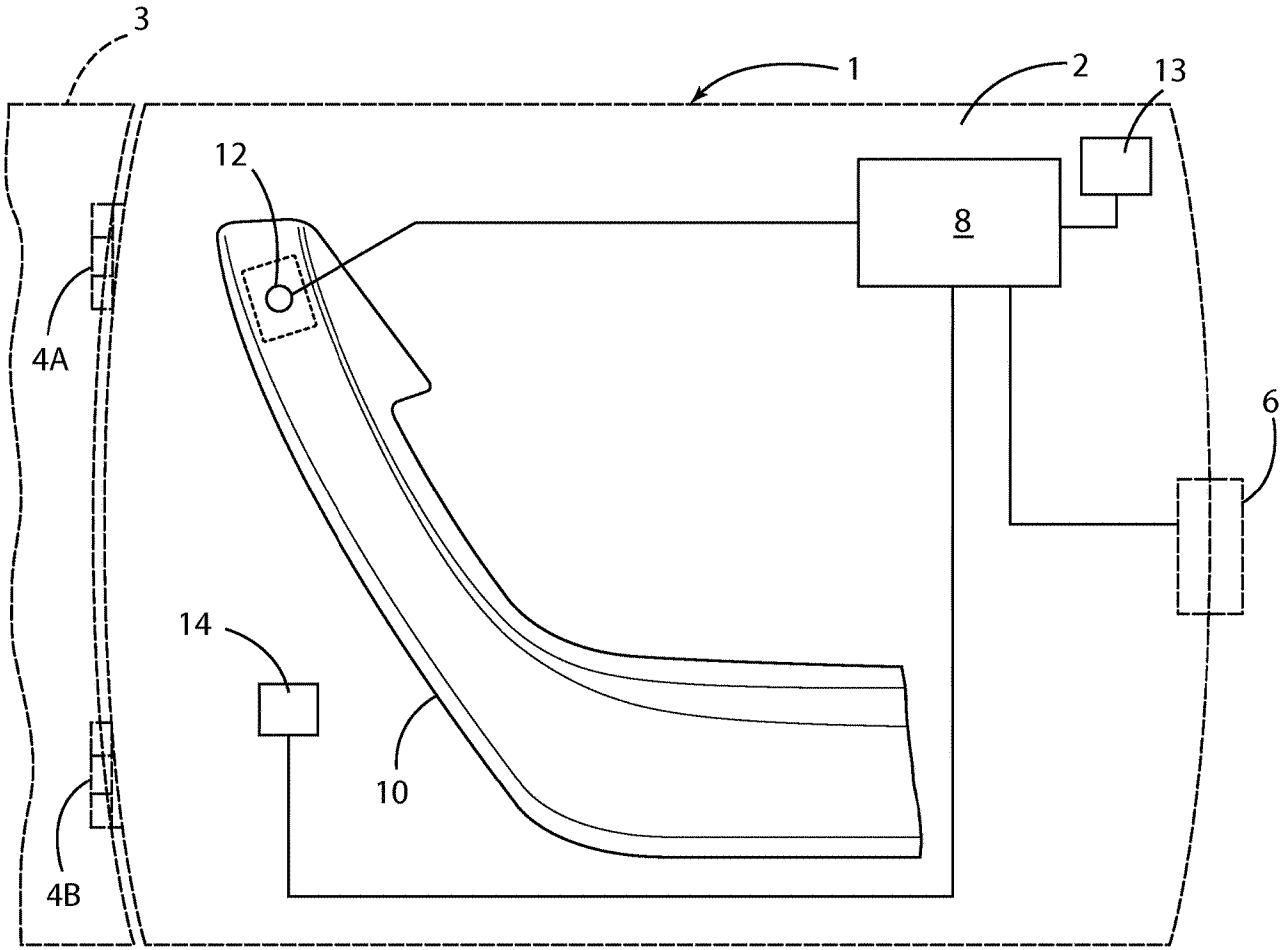
FIG. 1 is a partially schematic view of an interior side of a vehicle door having a powered latch according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a door 1 includes a door structure 2 that may be movably mounted to a vehicle structure 3 in a known manner utilizing hinges 4A and 4B Door 1 may also include an electrically powered latch that is configured to selectively retain the door 1 in a closed position. The powered latch 6 is operably connected to a controller 8. As discussed in more detail below, the controller 8 may comprise an individual control module that is part of the powered latch 6, and the vehicle may include a powered latch 6 at each of the doors of a vehicle. Door 2 may also include an interior unlatch input feature such as an interior unlatch switch 12 that is operably connected to the controller 8, and an exterior unlatch switch 13 that is also operably connected to controller 8. Interior unlatch switch 12 is disposed on an interior side of door 1 where it is accessible from inside the vehicle, and exterior unlatch switch 13 is disposed on an exterior side of door 1 and is accessible from the outside of the vehicle when door 1 is closed.

In use, a user actuates the interior unlatch switch 12 or exterior unlatch switch 13 to generate an unlatch request to the controller 8. As also discussed in more detail below, if the latch 6 is unlatched and/or certain predefined operating perimeters or conditions are present, controller 8 generates a signal causing powered latch 6 to unlatch upon actuation of interior unlatch switch 12. Door 2 may also include an unlock input feature such as an unlock switch 14 that is mounted to an inner side of the door 2. The unlock switch 14 is operably connected to the controller 8. Controller 8 may be configured to store a door or latch lock or unlock state that can be changed by actuation of unlock switch 14. Controller 8 may be configured (e.g. programmed) to deny an unlatch request generated by actuation of the interior unlatch switch 12 or exterior unlatch switch 13 if the controller 8 determines that the powered latch 6 is in a locked state. Controller 8 is preferably a programmable controller that can be configured to unlatch powered latch 6 according to predefined operating logic by programming controller 8. However, controller 8 may comprise electrical circuits and components that are configured to provide the desired operating logic. As used herein, the term "controller" may refer to one or more processors, circuits, electronic devices, and other such components and systems that are arranged to provide the desired control.

Figure 2:
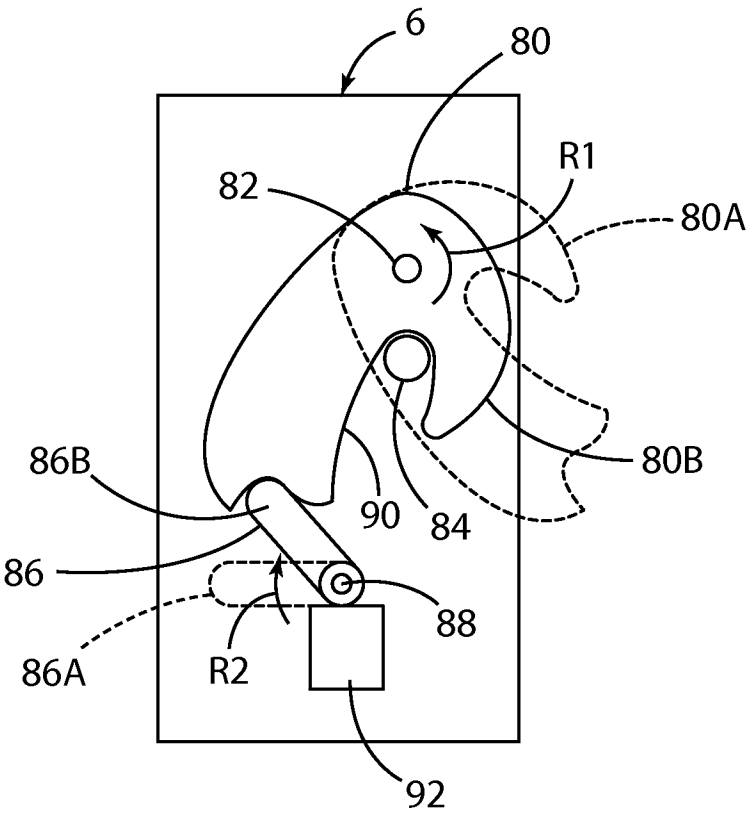
FIG. 2 is a schematic view of a powered latch.

With further reference to FIG. 2, powered latch 6 may include a claw 80 that pivots about a pivot 82 and a pawl 86 that is rotatably mounted for rotation about a pivot 88. Pawl 86 can move between a disengaged or unlatched position 86A and a latched or engaged configuration or position 86B. In use, when door 1 is open, claw 80 will typically be in an extended position 80A. As the door 1 is closed, surface 90 of claw 80 comes into contact with a striker 84 that is mounted to the vehicle structure. Contact between striker 84 and surface 90 of claw 80 causes the claw 80 to rotate about pivot 82 in the direction of the arrow "R1" until the claw 80 reaches the closed position 80B. When claw 80 is in the closed position 80B, and pawl 86 is in the engaged position 86B, pawl 86 prevents rotation of claw 80 to the open position 80A, thereby preventing opening of door 1. Claw 80 may be biased by a spring or the like for rotation in a direction opposite the arrow R1 such that the claw 80 rotates to the open position 80A unless pawl 86 is in the engaged position 86B. Pawl 86 may be biased by a spring or the like in the direction of the arrow R2 such that pawl 86 rotates to the engaged position 86B as claw 80 rotates to the closed position 80B as striker 84 engages claw 80 as door 1 is closed. Latch 6 can be unlatched by rotating pawl 86 in a direction opposite the arrow R2 to thereby permit rotation of claw 80 from the closed position 80B to the open position 80A. A powered actuator such as an electric motor 92 may be operably connected to the pawl 86 to thereby rotate the pawl 86 to the disengaged or unlatched position 86A. Controller 30 can unlatch powered latch 6 to an unlatched configuration or state by causing powered actuator 92 to rotate pawl 86 from the latched or engaged position 86B to the unlatched configuration or position 86A. However, it will be understood that various types of powered latches may be utilized in the present invention, and the powered latch 6 need not include the claw 80 and powered pawl 86 as shown in FIG. 2. For example, powered actuator 92 could be operably interconnected with the claw 80 utilizing a mechanical device other than pawl 86 to thereby shift the powered latch 6 between latched and unlatched states. In general, vehicle door 1 can be pulled open if powered latch 6 is in an unlatched state, but the powered latch 6 retains the vehicle door 1 in a closed position when the powered latch 6 is in a latched state or configuration.

Figure 3:
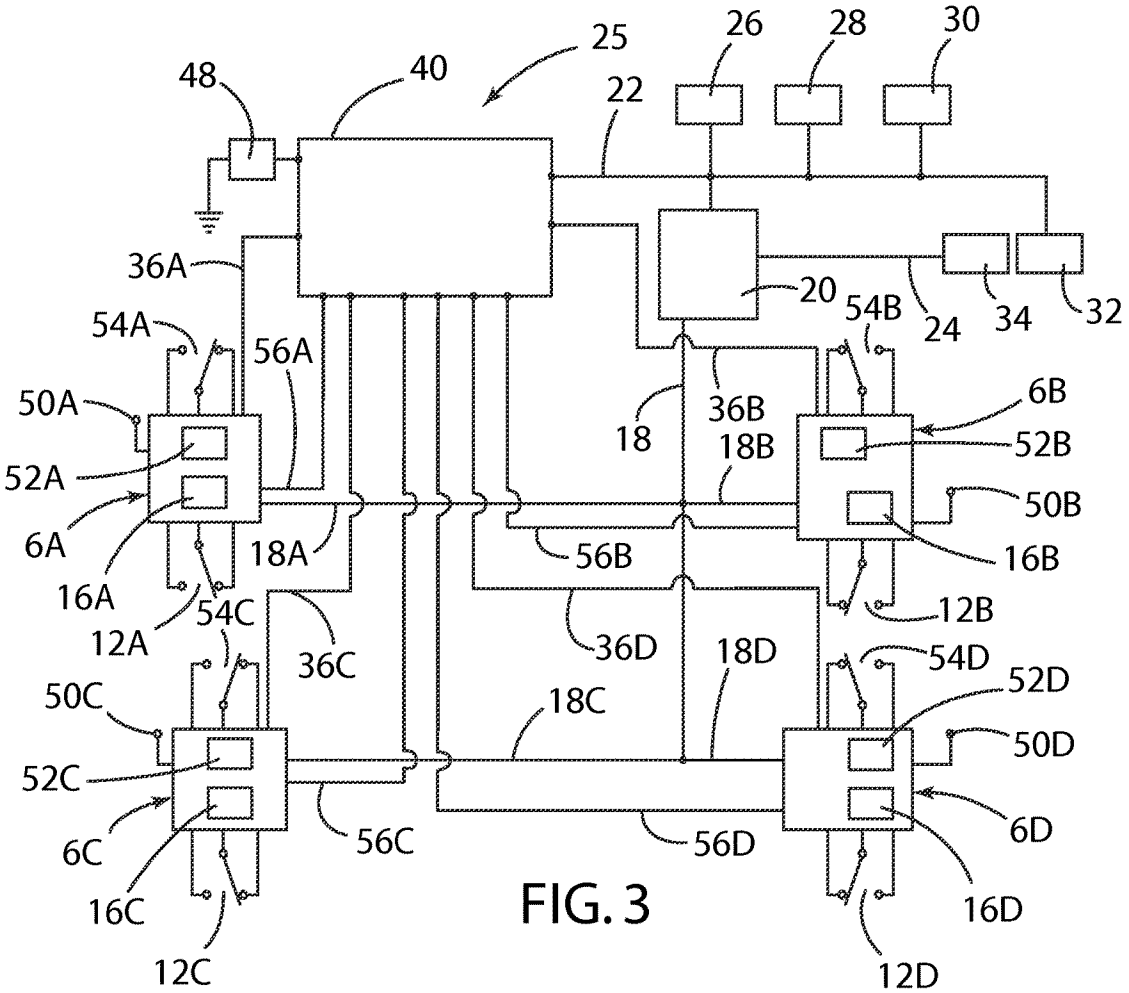
FIG. 3 is a diagram showing a latch system according to one aspect of the present invention.

With further reference to FIG. 3, a latch system 25 may include a driver's side front powered latch 6A, a passenger side front powered latch 6B, a driver's side rear powered latch 6C and a rear passenger side powered latch 6D. The powered latches 6A-6D are configured to selectively retain the corresponding driver and passenger front and rear doors of a vehicle in a closed position. Each of the powered latches 6A-6D may include a controller 16A-16D, respectively, that is connected to a medium speed data network 18 including network lines 18A-18D. Controllers 16A-16D are preferably programmable controllers, but may comprise electrical circuits that are configured to provide the desired operating logic. The data network 18 may comprise a Medium Speed Controller Area Network ("MS-CAN") that operates according to known industry standards. Data network 18 provides data communication between the controllers 16A-16D and a digital logic controller ("DLC") gateway 20. The DLC gateway 20 is operably connected to a first data network 22, and a second data network 24. First data network 22 may comprise a first High Speed Controller Area Network ("HS1-CAN"), and the second data network 24 may comprise a second High Speed Controller Area Network ("HS2-CAN"). The data networks 22 and 24 may operate according to known industry standards. The first data network 22 is connected to an Instrument Panel Cluster ("IPC") 26, a Restraints Control Module ("RCM") 28, and a Powertrain Control Module ("PCM") 30. The RCM 28 utilizes data from acceleration sensors to determine if a crash event has occurred. The RCM 28 may be configured to deploy passenger restraints and/or turn off a vehicle's fuel supply in the vent a crash is detected. RCM 28 may be configured to generate an Emergency Notification System ("ENS") signal if a crash occurs. The ENS signal may be transmitted over one or both of the data networks 22 and 24 (preferably both). The RCM is also preferably connected ("hard wired') directly to each powered latch 6A-6D by wires (not shown) such that powered latches 6A-6D receive an ENS signal even if data networks 22 and 24 are not operational. The first high speed data network 22 may also be connected to a display screen 32 that may be positioned in a vehicle interior to provide visual displays to vehicle occupants. The second high speed data network 24 is operably connected to antilock brakes ("ABS") module 34 that includes sensors that measure a speed of the vehicle.

System 25 also includes a Body Control module ("BCM") 40 that is connected to the first high speed data network 22. The body control module 40 is also operably connected to the powered latches 6A-6D by data lines 36A-36D. Controllers 16A-16D may also be directly connected ("hard-wired") to control module 40 by electrical conductors such as wires 56A-56D, respectively. Wires 56A-56D may provide a redundant data connection between controllers 16A-16D and controller 40, or the wires 56A-56D may comprise the only data connection between controllers 16A-16D and controller 40. Control module 40 may also be operably interconnected to sensors (not shown) that signal the control module 40 if the vehicle doors are ajar. Control module 40 is also connected to a main vehicle electrical power supply such as a battery 48. Each of the powered latches 6A-6D may be connected to main vehicle power supply 48 by connectors 50A-50D. The powered latches 6A-6D may also include back up power supplies 52 that can be utilized to actuate the powered actuator 92 in the event the power supply from main vehicle power supply ("VPWR") 48 is interrupted or lost. The backup power supplies 52A-52D may comprise capacitors, batteries, or other electrical energy storage devices. In general, the backup power supplies 52A-52D store enough electrical energy to provide for temporary operation of controllers 16A-16*d*, and to actuate the powered actuators 92 a plurality of times to permit unlatching of the vehicle doors in the event the main power supply/battery 48 fails or is disconnected.

Each of the powered latches 6A-6D is also operably connected to a two pole (for example, both poles normally opened or one pole normally opened and one pole normally closed) interior unlatch switch 12A-12D, respectively, that provide user inputs (unlatch requests). The powered latches 6A-6D are also operably connected to an exterior unlatch switches 54A-54D, respectively. Controllers 16A-16D are also operably connected to unlock switches 14 (FIG. 1). Controllers 16A-16D may be configured to store the Lock Status ("Locked" or "Unlocked") and to utilize the Lock Status for control of powered latches 6A-6D as shown below in Tables 1 and 2.

The controller 40 and individual controllers 16A-16D may be configured to unlatch the powered latches based on various user inputs and vehicle operating perimeters as shown in Table 1:

TABLE 1

| Status of: | | | UNLATCH Operation per Door<br>Normal Non-Crash Behavior (Delay Operation to Validate Input was not from a Crash Event) | | | | | |
|---|---|---|---|---|---|---|---|---|
| MS-CAN 18 | | | Exterior | Interior | Interior Rear Door (First Geographic Region) | | Interior Rear Door (Second Geographic Region) | |
| Latch Power | SPEED | LOCK STATUS | Any Door | Front Door | Child Lock ON | Child Lock OFF | Child Lock ON | Child Lock OFF |
| OK | Speed < 3 kph | Locked & Alarm Armed | Powered Latch 6 Not Unlatched | Unlatch switch 12 actuated 2 times within 3 seconds | Powered Latch 6 Not Unlatched | Unlatch switch 12 actuated 2 times within 3 seconds | Powered Latch 6 Not Unlatched | Unlatch switch 12 actuated 2 times within 3 seconds |
| | | Locked | Powered Latch 6 Not Unlatched | Single actuation of Unlatch switch 12 | Powered Latch 6 Not Unlatched | Unlock switch 14 actuated to unlock, then Unlatch switch 12 actuated 2 times within 3 seconds | Powered Latch 6 Not Unlatched | Single actuation of Unlatch switch 12 |
| | | Unlocked | Single actuation of Exterior Unlatch switch 13 | Single actuation of Unlatch switch 12 | Powered Latch 6 Not Unlatched | Single actuation of Unlatch switch 12 | Powered Latch 6 Not Unlatched | Single actuation of Unlatch switch 12 |
| | 3 kph < Speed < 8 kph | ANY | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| | Speed > 8 kph | ANY | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| Down/ Lost | Unknown | Unknown | Last Known State | Unlock switch 14 actuated to unlock, then Unlatch switch 12 actuated 2 times within 3 seconds | Unlock switch 14 actuated to unlock, then Unlatch switch 12 actuated 2 times within 3 seconds | Unlock switch 14 actuated to unlock, then Unlatch switch 12 actuated 2 times within 3 seconds | Unlock switch 14 actuated to unlock, then Unlatch switch 12 actuated 2 times within 3 seconds | Unlock switch 14 actuated to unlock, then Unlatch switch 12 actuated 2 times within 3 seconds |

TABLE 2

| Status of: | | | UNLATCH Operation per Door<br>Crash Behavior (Operation After Crash Event Recognized) | | | |
|---|---|---|---|---|---|---|
| MS-CAN 18 | | LOCK | Exterior Any | Interior Front | Interior Door (First and Second Geographic Region) | |
| Latch Power | SPEED | STATUS | Door | Door | Child Lock ON | Child Lock OFF |
| OK | Speed < 3 kph | Locked & Alarm Armed | State Not Allowed (RCM 28 Off when Security System Armed) | | | |
| | | Locked | Powered Latch | Unlock switch 14 | Powered Latch 6 | Unlock switch 14 |

TABLE 2-continued

| Status of: MS-CAN 18 | | | UNLATCH Operation per Door Crash Behavior (Operation After Crash Event Recognized) | | | |
|---|---|---|---|---|---|---|
| | | LOCK | Exterior Any | Interior Front | Interior Door (First and Second Geographic Region) | |
| Latch Power | SPEED | STATUS | Door | Door | Child Lock ON | Child Lock OFF |
| | | | 6 Not Unlatched | actuated to unlock, then Unlatch switch 12 actuated 2 times within 3 seconds | Not Unlatched | actuated to unlock, then Unlatch switch 12 actuated 2 times within 3 seconds |
| | | Unlocked | Single actuation of Exterior Unlatch switch 13 after 10 seconds | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| | 3 kph < Speed < 8 kph | ANY | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| | Speed > 8 kph | ANY | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |
| Down/Lost | Unknown | Unknown | Powered Latch 6 Not Unlatched | Unlock switch 14 actuated to unlock, then Unlatch switch 12 actuated 2 times within 3 seconds | Powered Latch 6 Not Unlatched | Unlock switch 14 actuated to unlock, then Unlatch switch 12 actuated 2 times within 3 seconds |

In Tables 1 and 2, the term "Latch Power" signifies that the powered latches 6A-6D are receiving electrical power from the main vehicle power supply 48. Thus, if the vehicle main power supply 48 is not functioning properly and/or if the powered latches 6A-6D are electrically disconnected from main vehicle power supply 48, "Latch Power" will be "down" or "not ok."

It will be understood that the predefined speeds listed for implementation of the control logic in Tables 1 and 2 may vary depending on the requirements of a particular application. For example, the speed of 8 kph may be larger (e.g. 20 kph) or smaller, and the 3 kph speed may be lower (e.g. 1 or 2 kph).

As shown in Tables 1 and 2, the controllers 16A-16C and/or control module 40 may be configured (e.g. programmed) to control unlatching of powered latches 6A-6D according to different criteria as required for different geographic areas. Additionally, the control module may be configured to control unlatching behavior differently when a crash event condition is present as compared to normal or non-crash conditions. Table 1 represents an example of unlatching behavior (control logic) during normal (non-crash) conditions whereas Table 2 represents unlatching behavior (control logic) during crash conditions. The controllers 16A-16C and/or control module 40 may be configured to recognize a crash condition by monitoring the data network for a crash signal from the RCM 28 and/or by monitoring various other direct signal inputs from the RCM 28. As discussed below, the RCM 28 may be configured to determine if a crash event has occurred (i.e. a crash condition exists) and generate one or more crash signals that may be communicated to the latch controllers 16A-16C and/or control module 40. Upon recognizing that a crash condition exists, the controller 16A-16C and/or control module 40 may also be configured to initiate a timer and to disallow any unlatching operation for a predefined time interval (e.g. 3 seconds) before resuming the crash behavior (control logic or operating mode) described in Table 2.

The controllers 16A-16D and/or control module 40 may be configured to provide a first operating mode wherein the powered latches 6A-6D are unlatched if interior unlatch switch 12 is actuated once. The system may also include a second operating mode. When the system is in the second operating mode, the interior unlatch switch 12 must be actuated at least two times within a predefined time period (e.g. 3 seconds). For example, this operating mode may be utilized when the vehicle is locked and the vehicle security system is armed.

As discussed above, the control module 40 may be operably interconnected with the controllers 16A-16D by data network 18 and/or data lines 36A-36D. Control module 40 may also be operably interconnected with the controllers 16A-16D by "hard" lines or conductors 56A-56D to provide redundancy. Alternatively, the system 25 may be configured such that the control module 40 is connected to the controllers 16A-16D only by network 18, or only by data lines 36A-36D, or only by conductors 56A-56D. Also, the RCM 28 may be connected to controllers 16A-16D of powered latches 6A-6D by data network 18, DLC gateway 20, and HS1-CAN 22, and RCM 28 may also be "hardwired" directly to the controllers 16A-16D of powered latches 6A-6D by electrical lines (not shown). These redundant connections between latch controllers 16A-16D and RCM 28 ensure that the powered latches 6A-6D can receive an Emergency Notification System ("ENS") signal directly from RCM 28 in the event one or more of the data networks 18 and 20 and/or other components malfunction.

During normal operation, or when the vehicle is experiencing various operating failures, the system 25 may also be configured to control the powered latches 6A-6D based on various operating parameters and/or failures within the vehicles electrical system, the data communication network, the hardwires, and other such parameters or events.

For example, during normal operation the system 25 may be configured to unlatch powered latches 6A-6D if interior unlatch switch 12 is actuated at least once and if the vehicle is traveling below 3 kph or other predefined speed. The speed may be determined utilizing suitable sensors (e.g. sensors in ABS module 34). If the vehicle is traveling at or below 3 kph, the powered latches 6A-6D may also be unlatched if exterior unlatch switch 54 is actuated one or more times while unlocked. However, the controllers 16A-16D may be configured such that if the vehicle is traveling above 3 kph, the latches 6A-6D cannot be unlatched by actuating exterior unlatch switches 54A-54D. Likewise, if the vehicle is traveling below 3 kph and while locked and armed, the system 25 may be configured to unlatch powered latches 6A-6D if interior unlatch switches 12A-12D are actuated at least two times within a predefined time interval (e.g. 3 seconds).

The system 25 may be configured to debounce interior unlatch switches 12A-12D and/or exterior unlatch switches 54A-54D at a first time interval (e.g. 35 ms) during normal vehicle operation. However, the debounce may be performed at longer time intervals (100-150 ms) if the vehicle is in gear (e.g. PCM 30 provides a signal indicating that the vehicle transmission gear selector is in a position other than "Park" or "Neutral").

Furthermore, the system 25, in crash operation for example, may be configured to unlatch the powered latches 6A-6D based on multiple inputs from interior unlatch switch 12 and/or interior unlock switch 14. Specifically, the controllers 16A-16D may be configured to provide a three-input mode or feature and unlatch powered latches 6A-6D if three separate inputs from interior unlatch switches 12A-12D and interior unlock switches 14A-14D are received within a predefined time interval (e.g. 3 seconds or 5 seconds) in any sequence. For example, controllers 16A-16D may be configured such that three actuations of interior unlatch switch 12 or three actuations of unlock switch 14 within the predefined time interval results in unlatching of powered latches 6A-6D. Also, actuation of unlock switch 14 followed by two actuations of unlatch switch 12 within the predefined time period could be utilized as a combination of inputs that would unlatch powered latches 6A-6D. Similarly, two actuations of the unlatch switch 12 followed by a single actuation of unlock switch 14 within the predefined time period may be utilized as an input that causes the powered latches 6A-6D to unlatch. Still further, two actuations of unlock switch 14 followed by a single actuation of interior unlatch switch 12 could also be utilized as a combination of inputs resulting in unlatching of powered latches 6A-6D. Thus, three inputs from unlatch switch 12 and/or unlock switch 14 in any combination or sequence within a predefined time interval may be utilized by the system 25 to unlatch powered latches 6A-6D. This control scheme prevents inadvertent unlatching of powered latches 6A-6D, but also permits a user who is under duress to unlatch the doors if three separate inputs in any sequence or combination are provided. Additionally, system 25 may be configured such that the three-input mode/feature is active only under the presence of certain conditions. For example, the system 25 (e.g. controllers 16A-16D) may be configured to provide a three-input mode-feature if a crash condition is present and/or loss of data network condition occurs as recognized by the controllers 16A-16D.

If the system 25 includes only data network connections 36A-36D, or only includes "hardwire" lines 56A-56D, the controllers 16A-16D may be configured to require a plurality of actuations of interior unlatch switch 12 if either the network or hardwire connectivity with RCM 28 is lost. If the controllers 16A-16D cannot communicate with the RCM 28, the controllers 16A-16D do not "know" the status of RCM 28, such that the controllers 16A-16D cannot "know" if a crash or fuel cut-off event has occurred. Accordingly, the controllers 16A-16D can be configured to default to require multiple actuations of interior unlatch switches 12A-12D in the event communication with RCM 28 (or other components) is lost to insure that the powered latches 6A-6D are not inadvertently unlatched during a crash event that was not detected by the system due to a loss of communication with the RCM 28. Similarly, if the network connectivity is lost, the controllers 16A-16D will be unable to "know" the vehicle speed and may default to utilizing the last known valid vehicle speed. Alternatively, the controllers 16A-16D may be configured instead to assume by default that the vehicle speed is less than 3 kph if network connectivity is lost. This may be utilized in the unlatch operation behavior from processing the exterior unlatch switches 54A-54D and/or the interior switches. It will be understood that controllers 16A-16D may be configured to determine if network connectivity has been "lost" for purposes of controlling latch operations based on predefined criteria (e.g. an intermittent data connection) that does not necessarily require a complete loss of network connectivity.

The system 25 may include both network (data) connections 18-18D and "hard" lines (not shown), wherein the hard lines directly interconnect the controllers 16A-16D to RCM 28 whereby the controllers 16A-16D receive an ENS signal and through the data and/or hardwire connections, the controllers 16A-16D may be configured to default to a mode requiring multiple actuations of interior unlatch switch 12 if both the data and hardwire connections are disrupted or lost. However, if either of the data or hardwire connections remain intact, the controllers 16A-16D can be configured to require only a single actuation of interior unlatch switch 12, provided the vehicle is known to be below a predefined maximum allowable vehicle speed and other operating parameters that would otherwise trigger a requirement for multiple actuations of interior unlatch switches 12A-12D.

Furthermore, the controllers 16A-16D may be configured to default to a mode requiring multiple actuations of interior unlatch switches 12A-12D if the power to latches 6A-6D from main vehicle power supply 48 is interrupted, even if the network connectivity with RCM 28 remains intact. This may be done to preserve the backup power supplies 52A-52D. Specifically, continued monitoring of the data network by controllers 16A-16D will tend to drain the backup power supplies 52A-52D, and the controllers 16A-16D may therefore be configured to cease monitoring data from data lines 36A-36D and/or network 18 in the event power from main vehicle power supply 48 is lost. Because the controllers 16A-16D cease monitoring the data communication upon failure of main power supply 48, the individual controllers 16A-16D cannot determine if a crash event has occurred (i.e. the controllers 16A-16D will not receive a data signal from RCM 28), and the controllers 16A-16D therefore default to require multiple actuations of interior unlatch switches 12A-12D to insure that the latches 6A-6D are not inadvertently unlatched during a crash event that was not detected by controllers 16A-16D. Additionally, in such cases the controllers 16A-16D will likewise be unable to determine vehicle speed and may be configured (e.g. programmed) to default to utilizing the last known valid vehicle speed. Alternatively, the controllers 16A-16D may instead be configured to "assume" by default that the vehicle speed is less than a predefined speed (e.g. 3 kph). These defaults, assumptions may be utilized in the unlatch operation behavior when processing inputs from the exterior unlatch switches 54A-54D and/or the interior switches 12A-12D.

Furthermore, the system may be configured to default to require multiple actuations of interior unlatch switches 12A-12D in the event the data network connection (network 18 and/or data lines 36A-36D) connectivity between the controllers 16A-16D and RCM 28 is lost. Specifically, even if the "hard" lines 56A-56D remain intact, the data transfer rate of the hard lines 56A-56D is significantly less than the data transfer rate of the network 18 and data lines 36A-36D, such that the controllers 16A-16D may not receive crash event data from RCM 28 quickly enough to shift to a mode requiring multiple actuations of interior unlatch switches 12A-12D if the crash data can only be transmitted over the hard lines 38A-38D. Thus, defaulting to a mode requiring multiple actuations of interior unlatch switches 12A-12D upon failure of data communications (network 18 and/or data lines 36A-36D) even if the hardwire communication lines remain intact insures that the powered latches 6A-6D are not inadvertently unlatched during a crash event that was detected by the controllers 16A-16D only after a delay due to a slower data transfer rate. Similarly, in such cases where the controllers 16A-16D are not communicating over the data network, they will be unable to "know" the vehicle speed as well and may default to utilizing the last known valid vehicle speed. Alternatively, the controllers 16A-16D may instead be configured to "assume" by default that the vehicle speed is less than a predefined speed (e.g. 3 kph). These defaults/assumptions may be utilized in the unlatch operation behavior when processing inputs from the exterior unlatch switches 54A-54D and/or the interior switches 12A-12D.

The controller 40 and individual controllers 16A-16D may, alternatively, be configured to unlatch the powered latches based on various user inputs and vehicle operating parameters as shown in Table 3.

TABLE 3

| Status of: | | | UNLATCH Operation per Door Normal during Non-Crash Behavior (Delay Operation 120 ms to Validate Input was not from a Crash Event) | | | | | |
|---|---|---|---|---|---|---|---|---|
| MS-CAN 18 ENS | | LOCK | Exterior Any | Interior Front | Interior Rear Door (First Geographic Region) | | Interior Rear Door (Second Geographic Region) | |
| Latch Power | SPEED | STATUS | Door | Door | Child Lock ON | Child Lock OFF | Child Lock ON | Child Lock OFF |
| All 3 OK | Speed < 3 kph | Locked & Alarm Armed | Powered Latch 6 Not Unlatched | Unlatch switch 12 actuated 2 times within 3 seconds Or Unlock switch 14 actuated followed by Unlatch switch 12 actuated within 3 seconds | Powered Latch 6 Not Unlatched | Unlatch switch 12 actuated 2 times within 3 seconds Or Unlock switch 14 actuated followed by Unlatch switch 12 actuated within 3 seconds | Powered Latch 6 Not Unlatched | Unlatch switch 12 actuated 2 times within 3 seconds Or Unlock switch 14 actuated followed by Unlatch switch 12 actuated within 3 seconds |
| | | Locked | Powered Latch 6 Not Unlatched | Single actuation of Unlock switch 12 Or (Config1 = Enabled Unlock switch 14 actuated followed by Unlatch switch 12 actuated within 3 seconds) | Powered Latch 6 Not Unlatched | Unlock switch 14 actuated to unlock, then Unlatch switch 12 actuated (no time bound) | Powered Latch 6 Not Unlatched | Single actuation of Unlock switch 12 or (Config1 = Enabled Unlock switch 14 actuated followed by Unlatch switch 12 actuated within 3 seconds) |
| | | Unlocked | Single actuation of Exterior Unlatch switch 13 | Single actuation of Unlock switch 12 Or (Config1 = Enabled Unlock switch 14 actuated followed by Unlatch switch 12 actuated within 3 seconds) | Powered Latch 6 Not Unlatched | Single actuation of Unlock switch 12 Or (Config1 = Enabled Unlock switch 14 actuated followed by Unlatch switch 12 actuated within 3 seconds) | Powered Latch 6 Not Unlatched | Single actuation of Unlock switch 12 or (Config1 = Enabled Unlock switch 14 actuated followed by Unlatch switch 12 actuated within 3 seconds) |
| | 3 kph < Speed < 20 kph | Unlocked | Single actuation of Exterior Unlatch switch 13 | Unlock switch 14 actuated followed by Unlatch switch 12 actuated within 3 seconds | Powered Latch 6 Not Unlatched | Unlock switch 14 actuated followed by Unlatch switch 12 actuated within 3 seconds | Powered Latch 6 Not Unlatched | Unlock switch 14 actuated followed by Unlatch switch 12 actuated within 3 seconds |
| | 3 kph < Speed < 20 kph | Locked | Powered Latch 6 Not Unlatched | Unlock switch 14 actuated followed by Unlatch switch 12 actuated within 3 seconds | Powered Latch 6 Not Unlatched | Unlock switch 14 actuated followed by Unlatch switch 12 actuated within 3 seconds | Powered Latch 6 Not Unlatched | Unlock switch 14 actuated followed by Unlatch switch 12 actuated within 3 seconds |
| | Speed > 20 kph | ANY | Powered Latch 6 Not Unlatched | Unlock switch 14 actuated followed by Unlatch switch 12 actuated within 3 seconds | Powered Latch 6 Not Unlatched | Unlock switch 14 actuated followed by Unlatch switch 12 actuated within 3 seconds | Powered Latch 6 Not Unlatched | Unlock switch 14 actuated followed by Unlatch switch 12 actuated within 3 seconds |

The operating logic shown above in Table 3 corresponds to normal non-crash operating conditions. In Table 3, "LATCH Power" signifies that a given powered latch 6A-6D is receiving electrical power from the main vehicle electrical power system 48. Thus, Table 3 applies if MS-CAN 18 is "up" (i.e. operating properly) and no ENS (crash) signal has been generated by the RCM 28, and the powered latches 6A-6D have electrical power from the vehicle's main power system 48. If these conditions are present and interior unlatch switch 12 or exterior unlatch switch 13 is actuated, the system initially delays implementation of the unlatch operations listed in Table 3 by 120 ms to validate that the input from switch 12 and/or switch 13 was not caused by a crash event. As discussed below, if a crash even has occurred, the system implements the control parameters/logic of Tables 5 and 6.

As shown in Table 3, the control system may be configured to provide a first operating logic for a first geographic region, and a second operating logic for a second geographic region with respect to the child lock state. Specifically, as shown in Table 3, when the child lock is in an ON state, the powered latch is not unlatched due to actuation of interior unlatch switch 12 under any circumstances (when the child lock is ON, actuation of exterior unlatch switch 13 will unlatch the door if it is not locked). However, if the child lock is in an "OFF" state, the system operates according to different logic depending on whether or not the control system is configured for a first geographic region or a second geographic region. The system can be configured for the first geographic region or the second geographic region by controlling one or more of the controllers 16A-16C and/or control module 40, and/or by modifying the circuit of FIG. 4. The ability to reconfigure the control system to provide different operating logic depending on the requirements of a particular market greatly reduces the need to design/fabricate different latch systems for different geographic regions.

The controllers may also be configured to control the powered latches based on the status of the MS-CAN 18, ENS, and Latch Power as shown in Table 4:

TABLE 4

| | | | | UNLATCH Operation per Door Normal Non-Crash Behavior (Delay Operation 120 ms to Validate Input was not from a Crash Event) | | | | | |
|---|---|---|---|---|---|---|---|---|---|
| MS-CAN 18 | | | | Exterior | Interior | Interior Rear Door (First Geographic Region) | | Interior Rear Door (Second Geographic Region) | |
| ENS Latch Power | | SPEED | LOCK STATUS | Any Door | Front Door | Child Lock ON | Child Lock OFF | Child Lock ON | Child Lock OFF |
| Last Known MS-CAN 18 = Down Last Known ENS = UP Latch Power = Down | Lost MS-CAN 18 | Unknown | Unlocked | Exterior Unlatch Switch 13 actuated 2 times within 3 seconds | Unlock switch 14 actuated followed by Unlatch switch 12 actuated within 3 seconds | Powered Latch 6 Not Unlatched | Unlock switch 14 actuated followed by Unlatch switch 12 actuated within 3 seconds | Powered Latch 6 Not Unlatched | Unlock switch 14 actuated followed by Unlatch switch 12 actuated within 3 seconds |
| | | | Locked | Powered Latch 6 Not Unlatched | | | | | |
| Last Known MS-CAN 18 = Down Last Known ENS = UP Latch Power = UP | Lost MS-CAN 18 | Unknown | Unlocked | Exterior Unlatch Switch 13 actuated 2 times within 3 seconds | Unlock switch 14 actuated followed by Unlatch switch 12 actuated within 3 seconds | Powered Latch 6 Not Unlatched | Unlock switch 14 actuated followed by Unlatch switch 12 actuated within 3 seconds | Powered Latch 6 Not Unlatched | Unlock switch 14 actuated followed by Unlatch switch 12 actuated within 3 seconds |
| Last Known MS-CAN 18 = Down Last Known ENS = Down Latch Power = UP Last known state = Normal MS-CAN 18 sleep | Lost ENS & lost MS-CAN 18 | Last known speed valid | Any | Normal-Uses Last Known State of Vehicle speed, lock state, PRNDL, and Ignition until new information | Normal-Uses Last Known State of Vehicle speed, lock state, PRNDL, and Ignition until new information | Powered Latch 6 Not Unlatched | Normal-Uses Last Known State of Vehicle speed, lock state, PRNDL, and Ignition until new information | Powered Latch 6 Not Unlatched | Normal-Uses Last Known State of Vehicle speed, lock state, PRNDL, and Ignition until new information |
| Last Known MS-CAN 18 = Down Last Known ENS = Down Latch Power = UP | Lost ENS & lost MS-CAN 18 | Last known speed valid | Unlocked | Exterior Unlatch Switch 13 actuated 2 times within 3 seconds | Unlock switch 14 actuated followed by Unlatch switch 12 actuated within 3 seconds | Powered Latch 6 Not Unlatched | Unlock switch 14 actuated followed by Unlatch switch 12 actuated within 3 seconds | Powered Latch 6 Not Unlatched | Unlock switch 14 actuated followed by Unlatch switch 12 actuated within 3 seconds |
| Last Known State = NOT Normal MS-CAN 18 sleep | | | Locked | Powered Latch 6 Not Unlatched | | | | | |
| Last Known MS-CAN 18 = Down Last Known ENS = Down | Lost ENS & lost MS-CAN | Last known speed valid | Unlocked | Exterior Unlatch Switch 13 actuated 2 times | Unlock switch 14 actuated followed by | Powered Latch 6 Not Unlatched | Unlock switch 14 actuated followed by | Powered Latch 6 Not Unlatched | Unlock switch 14 actuated followed by |

TABLE 4-continued

| MS-CAN 18 | | | | UNLATCH Operation per Door Normal Non-Crash Behavior (Delay Operation 120 ms to Validate Input was not from a Crash Event) | | | | | |
|---|---|---|---|---|---|---|---|---|---|
| | | | | Exterior | Interior | Interior Rear Door (First Geographic Region) | | Interior Rear Door (Second Geographic Region) | |
| ENS Latch Power | | SPEED | LOCK STATUS | Any Door | Front Door | Child Lock ON | Child Lock OFF | Child Lock ON | Child Lock OFF |
| Latch Power = Down | 18 | | Locked | within 3 seconds Powered Latch 6 Not Unlatched | Unlatch switch 12 actuated within 3 seconds | | Unlatch switch 12 actuated within 3 seconds | | Unlatch switch 12 actuated within 3 seconds |
| MS-CAN 18 = UP ENS = Down Latch Power = UP Last Known state = NOT Normal MS-CAN 18 sleep (if Latch Power down then MS-CAN Down) | Lost ENS | Known but may be in crash | Unlocked | Exterior Unlatch Switch 13 actuated 2 times within 3 seconds | Unlock switch 14 actuated followed by Unlatch switch 12 actuated within 3 seconds | Powered Latch 6 Not Unlatched | Unlock switch 14 actuated followed by Unlatch switch 12 actuated within 3 seconds | Powered Latch 6 Not Unlatched | Unlock switch 14 actuated followed by Unlatch switch 12 actuated within 3 seconds |
| | | | Locked | Powered Latch 6 Not Unlatched | | | | | |
| MS-CAN 18 = UP ENS = Down Last Known State = Normal Sleep (if Latch Power down then MS-CAN Down) | Lost ENS | Known but may be in crash | ANY | NORMAL | NORMAL | Powered Latch 6 Not Unlatched | NORMAL | Powered Latch 6 Not Unlatched | NORMAL |

The operating logic shown in Table 4 may be utilized if the vehicle speed is unknown due to the MS-CAN 18 network communication being lost and/or if the ENS is lost.

Furthermore, as shown in Tables 5 and 6, the system may be configured to operate the powered latches if a crash event is recognized.

TABLE 5

| Status of: | | | UNLATCH Operation per Door Crash Behavior (Operation After Crash Event Recognized) | | | |
|---|---|---|---|---|---|---|
| MS-CAN 18 Or | | LOCK | Exterior Any | Interior Front | Interior Door (First and Second Geographic Region) | |
| Latch Power | SPEED | STATUS | Door | Door | Child Lock ON | Child Lock OFF |
| OK | Speed < 3 kph | Locked & Alarm Armed | State Not Allowed (RCM 28 Off when Security System Armed) | | | |
| | | Locked | Powered Latch 6 Not Unlatched for first 6 seconds After 6 seconds unlatch according to noncrash (Table 4) but treat as vehicle speed = 0 | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds. | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds. |
| | | Unlocked | Powered Latch 6 Not Unlatched for first 6 seconds. After 6 seconds unlatch according to noncrash (Table 4) but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds. | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds. |

TABLE 5-continued

| Status of: | | | UNLATCH Operation per Door Crash Behavior (Operation After Crash Event Recognized) | | | |
|---|---|---|---|---|---|---|
| MS-CAN 18 Or | | LOCK | Exterior Any | Interior Front | Interior Door (First and Second Geographic Region) | |
| Latch Power | SPEED | STATUS | Door | Door | Child Lock ON | Child Lock OFF |
| | 3 kph < Speed < 20 kph | ANY | Powered Latch 6 Not Unlatched for first 6 seconds. After 6 seconds unlatch according to noncrash (Table 4) but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds. | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds. |
| | Speed > 20 kph | ANY | Powered Latch 6 Not Unlatched for first 6 seconds. After 6 seconds unlatch according to noncrash (Table 4) but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds. | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds. |

TABLE 6

| Status of: | | | | UNLATCH Operation per Door Crash Behavior (Operation After Crash Event Recognized) | | | |
|---|---|---|---|---|---|---|---|
| MS-CAN 18 ENS | | | LOCK | Exterior Any | Interior Front | Interior Door (First and Second Geographic Region) | |
| Latch Power | | SPEED | STATUS | Door | Door | Child Lock ON | Child Lock OFF |
| Last Known MS-CAN 18 = Down Last Known ENS = UP Latch Power = down | Lost MS-CAN 18 | Unknown | ANY | Powered Latch 6 Not Unlatched for first 6 seconds. After 6 seconds unlatch according to noncrash but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds |
| Last Known MS-CAN 18 = Down Last Known ENS = UP Latch Power = UP | Lost MS-CAN 18 | Unknown | ANY | Powered Latch 6 Not Unlatched for first 6 seconds. After 6 seconds unlatch according to noncrash but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds |
| Last Known MS-CAN 18 = Down Last Known ENS = Down Latch Power = UP Last known state = Normal CAN sleep | Lost ENS & Lost MS-CAN 18 | Last known speed valid | ANY | Powered Latch 6 Not Unlatched for first 6 seconds. After 6 seconds unlatch according to noncrash but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds |

TABLE 6-continued

| Status of: | | | | UNLATCH Operation per Door Crash Behavior (Operation After Crash Event Recognized) | | | |
|---|---|---|---|---|---|---|---|
| MS-CAN 18 | ENS | | LOCK | Exterior Any | Interior Front | Interior Door (First and Second Geographic Region) | |
| Latch Power | | SPEED | STATUS | Door | Door | Child Lock ON | Child Lock OFF |
| Last Known MS-CAN 18 = Down Last Known ENS = Down Latch Power = UP Last Known State = Not Normal CAN sleep | Lost ENS & lost MS-CAN 18 | Last known speed valid | ANY | Powered Latch 6 Not Unlatched for first 6 seconds. After 6 seconds unlatch according to noncrash but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds |
| Last Known MS-CAN 18 = Down Last Known ENS = Down Latch Power = Down | Lost ENS & lost MS-CAN 18 | Last known speed valid | ANY | Powered Latch 6 Not Unlatched for first 6 seconds. After 6 seconds unlatch according to noncrash but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds |
| MS-CAN 18 = UP ENS = Down Latch Power = UP Last known state = Not Normal CAN sleep (if Latch Power down then CAN Down) | Lost ENS | Known but may be in crash | ANY | Powered Latch 6 Not Unlatched for first 6 seconds. After 6 seconds unlatch according to noncrash but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds |
| MS-CAN 18 = UP ENS = Down Last known State = Normal Sleep (if Latch Power down then MS-CAN down) | Lost ENS | Known but may be in crash | ANY | Powered Latch 6 Not Unlatched for first 6 seconds. After 6 seconds unlatch according to noncrash but treat as vehicle speed = 0. | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds | Powered Latch 6 Not Unlatched | Powered Latch 6 Not Unlatch for first 6 seconds. After 6 seconds Unlock switch 14 actuated to unlock, then Unlatch switch 12 actuated within 3 seconds or Unlatch switch 12 actuated 2 times within 3 seconds |

Still further, as shown in Table 6, the system may be configured to control the powered latches based on the status of the MS-CAN network 18, ENS, Latch Power, and vehicle speed after a crash event is recognized.

In Tables 3-6, "ENS" represents the presence of a signal from the Emergency Notification System. The ENS comprises a signal from the restraints control module 28. The restraints control module 28 may be configured to continuously (or at very short time intervals) send a signal over the HS1-CAN 22. The signal is sent continuously unless the RCM 28 and/or HS1-CAN 22 or other components are damaged (e.g. in a crash). The RCM 28 normally sends a continuous "no event" signal. However, in the event of a crash, the RCM 28 may send a "deployment event" signal or a "fuel shutoff event" signal. The latch system 25 may be configured to treat the "deployment event" and "fuel shut off event" signals from RCM 28 in the same manner, and interpret these signals as meaning that a crash event has occurred. In the event the ENS signal is lost completely, the system controls the powered latches as shown in Tables 4 and 6.

Also, in Tables 3, 4, and 6, the latch power may be utilized as an input by the system 25 to control the unlatching of the powered latches. The latch power of the tables corresponds to the status of the backup power supplies 52 of the powered latches 6A-6D. Specifically, the body control module 40 and/or individual controllers 16A-16D may be configured to continuously check the individual backup power supplies 52A-52D to thereby control operation based on whether or not the individual latch power supplies 52 are "up" (working properly according to predefined criteria) or "down" (not operating properly according to predefined criteria).

As also shown in Tables 4 and 6, the system 25 may be configured to take into account the condition of the MS-CAN "sleep." Specifically, the MS-CAN 18, HS1-CAN 22, and/or HS2-CAN 24 may be configured to go into a "sleep" mode to reduce power consumption if the components of the system are sufficiently inactive according to predefined criteria. When the data networks 18, 22, and/or 24 go into the "sleep" mode, the system generates a signal whereby the various components in the system can determine if the networks 18, 22, and 24 are in sleep mode or if the networks have stopped functioning due to a loss of power or other malfunction. Thus, for example, as shown in Table 4, if the powered latch system 25 determines that the last known state was not a normal MS-CAN 18 sleep state, this indicates that the MS-CAN 18 is not in operation rather than being in a sleep mode. If the last known state was normal MS-CAN 18 sleep mode, the system controls the powered latches 6A-6D accordingly. As shown in Table 4, when the child lock is OFF, the system utilizes a normal operating logic if the last known state is normal MS-CAN 18 sleep. However, in the event the last known state is not normal MS-CAN 18 sleep, the interior rear door is only unlatched if the unlock switch 14 is actuated followed by unlatch switch 12 being actuated within 3 seconds. As shown in Table 4, this aspect of the control logic is the same in the first and second geographic regions.

Also, as noted above and as shown in Tables 3 and 4, the unlatching operations are initially delayed by 120 ms following actuation of unlatch switch 12 or 13. The 120 ms delay is utilized by the system to determine if the actuation of switch 12 or 13 was due to a crash event. Specifically, if one or both of the unlatch switches 12 or 13 are actuated due to a crash event, the RCM 28 will generate a signal in less than 120 ms indicating that a crash event (e.g. deployment event or fuel shutoff event) has occurred. If a crash event has occurred, the operation of the powered latches is controlled as shown in Tables 5 and 6 rather than the control logic shown in Tables 3 and 4.

As shown in Tables 5 and 6, actuation of exterior switch 13 does not, under any circumstances, result in unlatching during the first 6 seconds following a crash event (i.e. a "crash" signal from RCM 28). Thus, exterior unlatching following a crash event is delayed or blocked for a predefined period of time. The delay is preferably about 6 seconds, but it could be as short as 1 second, or it could be 30 seconds, 60 seconds, or other suitable period of time.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A latch system for vehicle doors of a vehicle, the latch system comprising:

a powered latch including a powered actuator that is configured to unlatch the powered latch;

an interior unlatch input feature that can be actuated by a user to provide an unlatch request;

a controller operatively connected to the powered latch and the interior unlatch input feature;

a control system including at least one sensor configured to collect data of the vehicle, and a restraints control module, operably connected to the at least one sensor, the restraint control module configured to collect the data from the at least one sensor and to determine if a crash even has occurred;

wherein, the control system analyses the collected data and send it to the controller, the controller causes the powered latch to unlatch if predefined unlatch criteria exist, wherein the predefined unlatch criteria comprises actuation of the interior unlatch feature at a first time and at least one additional user input that occurs within a predefined first time interval from the first time, unless the control system determines that a vehicle crash has occurred at a second time, in which case the controller does not cause the powered latch to unlatch even if the predefined unlatch criteria exist during a predefined second time interval from the second time, such that the controller does not cause the powered latch to unlatch until after the second time interval.

2. The latch system of claim 1, wherein:

the control system includes first and second data networks that are operatively interconnected by a gateway device.

3. The latch system of claim 2, wherein:

the control module comprises a restraints control module (RCM) that is configured to detect a vehicle crash to actuate one or more constraints;

the RCM is operatively connected to the first data network; and the control system includes a Body Control Module (BCM) operatively connected to the first data network, and a latch controller operatively connected to the second data network.

4. The latch system of claim 1, wherein:

the at least one additional user input comprises a second actuation of the interior unlatch input feature.

5. The latch system of claim 1, including:

an unlock input feature that can be actuated by a user to provide an unlock request; and wherein:

the at least one additional user input comprises actuation of the unlock input feature.

6. The latch system of claim 1, wherein:

the at least one additional user input comprises either actuation of the unlock input feature or a second actuation of the interior unlatch input feature.

7. The latch system of claim 1, wherein:

the first time interval is in the range of about one second to about six seconds.

8. The latch system of claim 1, wherein:

the second time interval is in the range of about two seconds to about ten seconds.

9. The latch system of claim 1, wherein:

the first time interval is about three seconds, and the second time interval is about six seconds.

10. The latch system of claim 1, wherein:

an interior unlock input feature that can be actuated by a user to provide an unlock request.

11. The method of claim 10, wherein:

the control system is configured such that it does not unlatch the powered latch if a vehicle speed is greater than a predefined value unless the interior unlock feature is actuated followed by actuation of the interior unlatch feature within a predefined time interval following actuation of the interior unlock feature.

12. A latch system for vehicle doors of a vehicle, the latch system comprising:

a powered latch including a powered actuator that is configured to unlatch the powered latch;

an interior unlatch input feature that can be actuated by a user to provide an unlatch request;

an interior unlock input feature that can be actuated by a user to provide an unlock request;

a controller operatively connected to the powered latch and the interior unlatch input feature;

a control system including at least one sensor configured to collect data of the vehicle, and a restraints control module, operably connected to the at least one sensor, the restraint control module configured to collect the data from the at least one sensor and to determine if a crash even has occurred, the control system further including a first and a second data networks that are operatively interconnected by a Digital Logic Gateway Controller (DLC);

wherein the control system analyses the collected data and send it to the controller; the controller is configured such that it does not unlatch the powered latch if a vehicle speed is greater than a predefined value unless the interior unlock feature is actuated followed by actuation of the interior unlatch feature within a predefined time interval following actuation of the interior unlock feature; and the controller unlatches the powered latch if predefined unlatch criteria exist, wherein the predefined unlatch criteria comprises actuation of the interior unlatch feature at a first time and at least one additional user input that occurs within a predefined first time interval from the first time, unless the control system determines that a vehicle crash has occurred at a second time, in which case the controller does not cause the powered latch to unlatch even if the predefined unlatch criteria exist during a predefined second time interval from the second time, such that the controller does not cause the powered latch to unlatch until after the second time interval.

13. The latch system of claim 12, including:

an exterior unlatch input feature; and wherein:

actuation of the exterior unlatch input feature does not unlatch the powered latch unless the vehicle speed is less than a second predefined value.

* * * * *